United States Patent [19]

Porucznik et al.

[11] Patent Number: 5,069,052

[45] Date of Patent: Dec. 3, 1991

[54] METHOD FOR ROLL FORMING AND APPARATUS FOR CARRYING OUT THE METHOD

[75] Inventors: Paul Porucznik, Kennington; Keith Longstaff, Worcester, both of United Kingdom

[73] Assignee: CMB Foodcan plc, United Kingdom

[21] Appl. No.: 369,469

[22] Filed: Jun. 21, 1989

[30] Foreign Application Priority Data

Jun. 23, 1988 [GB] United Kingdom ..... 8814938

[51] Int. Cl.[5] ..... B21D 22/14

[52] U.S. Cl. ..... 72/84; 413/8; 72/110; 72/125

[58] Field of Search ..... 413/8, 11, 56; 72/84, 72/95, 110, 125, 126

[56] References Cited

U.S. PATENT DOCUMENTS 1,060,112 4/1913 Norton .
2,519,869 8/1950 Zeiler .
2,678,079 5/1954 Kradoska .
3,797,431 3/1974 Yoshimura .
4,058,998 11/1971 Franek et al. ..... 72/84

FOREIGN PATENT DOCUMENTS 0118201 9/1984 European Pat. Off. .
83/02577 8/1983 PCT Int'l Appl. .
2114031 8/1983 United Kingdom .

*Primary Examiner*—Frederick R. Schmidt
*Assistant Examiner*—Jack Lavinder
*Attorney, Agent, or Firm*—Christie, Parker & Hale

[57] ABSTRACT

Apparatus for reforming an end wall of a container comprises a pair of cooperating pads 10, 11 cooperable to clamp the wall firmly on a central axis of the pads and wall, and a cluster of work rolls 12 arranged around the pads so that when a clamped wall is entered into the profiled rolls 12 relative rotation as between the rolls 12 and protruding edge of the wall 1 brings about progressive deformation of the periphery of the wall.

The apparatus may be modified to form a peripheral curl on a can end or tighten the folds of a can bottom integral with a drawn side wall.

8 Claims, 3 Drawing Sheets

METHOD FOR ROLL FORMING AND APPARATUS FOR CARRYING OUT THE METHOD

This invention relates to a method of roll forming and more particularly but not exclusively to a method and apparatus for roll forming an end wall of a container, such as a loose can end or the integral end wall of a deep drawn can.

Loose can ends are usually drawn to a shape or shell having a peripheral channel portion, the peripheral wall portion of which is substantially cylindrical. In order to reform this cylindrical wall to an inwardly directed curl suitable for double seaming to a can body flange, it is usual to pass the drawn shell through a machine in which a rotating disc urges each can end to roll along a profiled rail which progressively converges towards the rotating disc so that the cylindrical wall of the shell is reformed to a desired curl. A problem arising with this curling process is that the curls produced may be irregular and, even worse, the shell shape may become distended. These problems are likely to be made worse if the can ends are made of stiffer double reduced tinplate or electrochrome-coated steels which may exhibit directional properties.

A related problem arises when forming the bottom wall of cans drawn from a circular blank of sheet metal. Typical beer and beverage cans are drawn from ferrous plates about 0.010" (0.25 mm) thick to have a cylindrical side wall closed at one end by an integral end wall. In one widely used beverage can the end wall comprises a frustoconical annulus the periphery of which joins the side wall; a domed central panel and an annular "stand bead" or channel portion which joins the central panel to the frustoconical annulus. The resistance of such domed end walls is much enhanced if the radius of curvature of the stand bead is tightened to a small radius as is discussed in our British Patent No. 2 114 031 B. According to GB No. 2 114 031 such a can bottom wall can be reshaped to good effect by supporting the can between a plug at the mouth and a pad contacting the domed bottom wall and while the can rotates applying a small roll to the frustoconical annulus so that pressure applied by the roll in a radial direction progressively crushes the stand bead to a tighter internal radius. A possible disadvantage with this method of roll reforming is that the roll has to be moved radially inwards to progressively apply a localised assymetric reforming load.

In contrast to the assymmetric loading of both the rail curler and the roll reforming method of GB No. 2 114 031, the present invention seeks to provide a method of reforming, at least circular articles, by means of a firmly located array of rotatable work rolls which are arranged symmetrically around the workpiece such that a single axial motion of a rotating workpiece into the array of rolls brings about the desired reforming.

In a first aspect this invention provides a method for reforming an end wall of a container, said method comprising the steps of (a) clamping the end wall between a first pressure plate and a second pressure plate so that said plates and end wall are in axial alignment and a peripheral portion of the end wall protrudes at least around the second plate;

(b) entering the clamped end wall into an array of freely rotatable rolls, which are mounted in a housing and each of which has a profiled work surface, to progressively reform the protruding portion of the end wall while causing the pressure plates with the end wall clamped between them to rotate while the housing is stationary;

(c) thereafter removing the assembly of reformed end wall and plates from the array; and (d) parting the pressure plates to release the reformed end wall.

In a second aspect this invention provides apparatus for reforming an end wall of a container, the apparatus comprising first support means adapted to be axially displaceable to apply axial pressure to the end wall, second support means adapted to support the end wall in axial alignment with the first support means against the axial pressure, means for rotation of the two support means with the end wall held between them and roll means adjacent the second support means to apply a forming force in a radial direction to progressively reform the end wall, wherein the second support means is a thrust pad having a thrust surface adapted to conform with a central portion of the end wall, and the roll means comprise an array of rolls mounted in a housing and equiangularly spaced around the thrust pad, the array of rolls presenting an envelope of thrust which, when the end wall is advanced by the first support means axially into the array of rolls, exerts an inwardly directed thrust force which reduces the diameter of the end wall.

In a first embodiment the apparatus comprises work rolls each of which has an arcuate annular profile which imparts to a can end a finished curl.

In a modified form of the first embodiment each roll is supported for rotation on an axis inclined to the axis of rotation of the can end so that the work load is directed perpendicularly to the axis of rotation to permit use of roller bearings (instead of tapered roller bearings).

In a second embodiment the apparatus comprises work rolls each which has a frustoconical surface adapted to engage a frustoconical annulus of a can bottom so that advance of a can bottom into an array of such rolls tightens the curvature of a stand bead adjacent said frustoconical annulus.

It is desirable that the work rolls rotate freely. In a preferred embodiment each roll is supported at one end by ball or roller bearings located in a base plate.

In order to eject the reformed article it is desirable that the second support means or pad is supported on a spring to lift the pad and hence the finished article out of the array of rolls after reforming of the end wall. A suitable form of springing is a stack of Belleville washers. As the second support means or pad has to survive many working operations, it is desirable that it be supported by a thrust bearing comprising rolls and thrust bearing plates.

Various embodiments will now be described by way of example and with reference to the accompanying diagrammatic drawings, in which.

Figure 2:
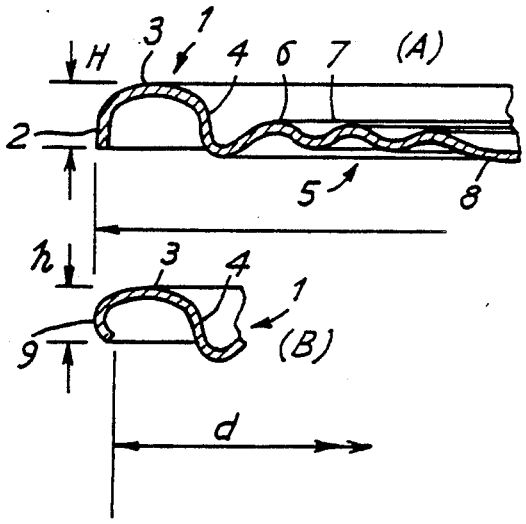
FIG. 2A is a fragmentary section through a can end shell showing the end shell as drawn in a press tool.
FIG. 2B is a fragmentary section through the can end of FIG. 2A formed by curling from the end shell.

Referring briefly to FIG. 2A, it will be seen that a preliminary can end shell 1, when stamped in a press tool, comprises a substantially cylindrical peripheral skirt 2 of diameter D, an arcuate annulus or seaming panel 3, a chuck wall 4 and a central panel 5. In this particular non-limiting example the central panel 5 comprises a plurality of concentric annular ribs 6, 7 surrounding a flat central panel portion 8.

In order to make the end shell 1 into a can end as shown in FIG. 2B it is necessary to curl the cylindrical skirt 2 radially inwards to form a peripheral curl 9 shown having an edge-to-edge diameter "d", whilst retaining the overall diameter "D" so that the can end may be attached by double seaming to the flange of a can body in known manner.

Figure 1A:
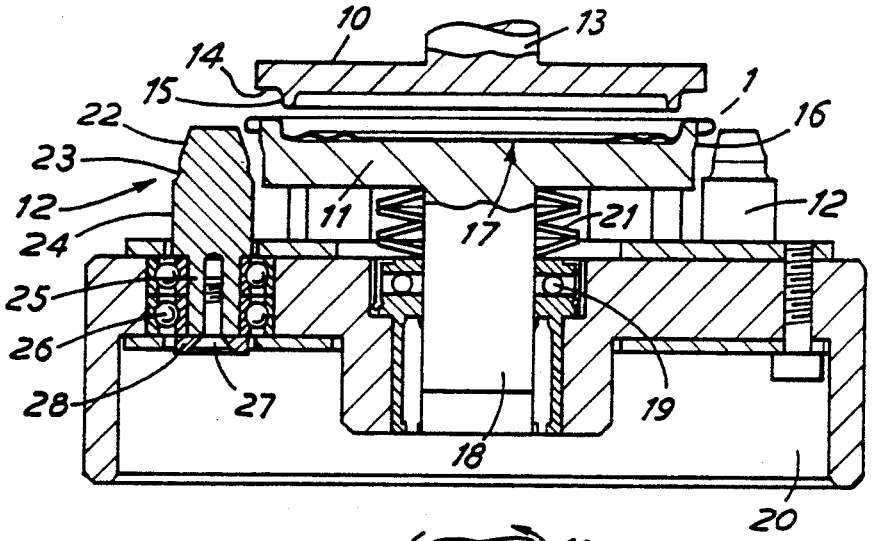
FIG. 1A is a side elevation of a first enbodiment of apparatus sectioned on Line A—A$^1$ in FIG. 1C and shown in the "open" state.
Figure 1B:
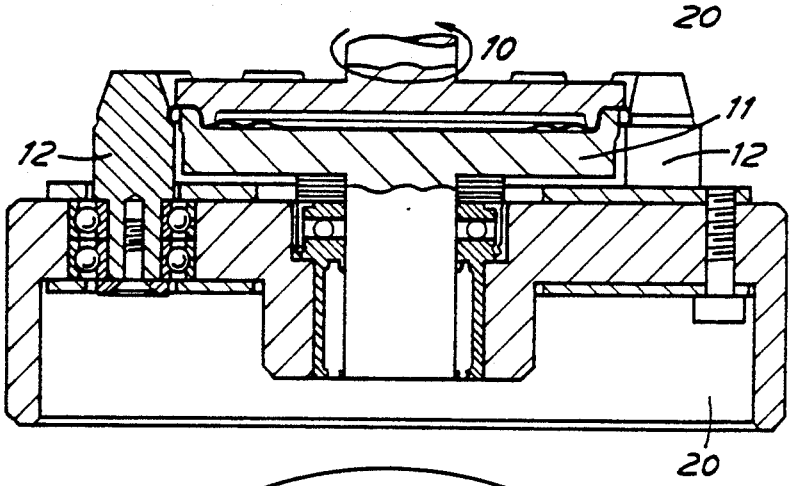
FIG. 1B is a like view to FIG. 1 but shows the apparatus in a closed or working position.
Figure 1C:
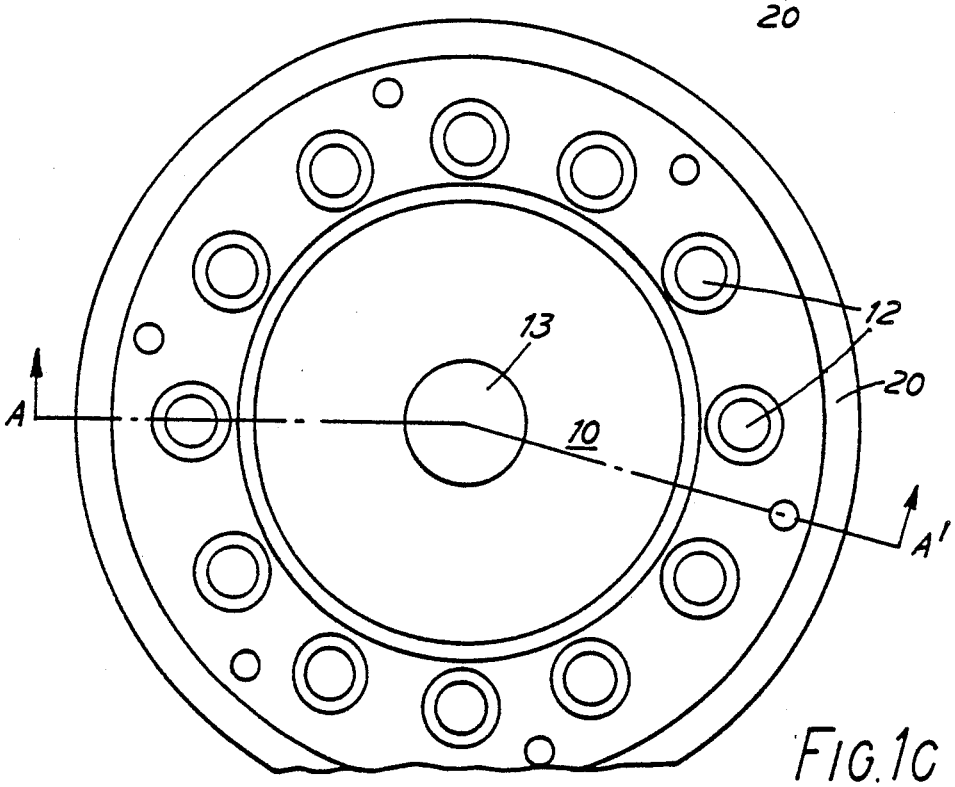
FIG. 1C is a plan view of the apparatus of FIGS. 1 and 1A.

The apparatus of FIGS. 1A, 1B, 1C is used to carry out the reforming step from the shell of FIG. 2A to the can end of FIG. 2B.

Referring to FIG. 1A it will be seen that this first embodiment of the apparatus comprises a first pressure plate 10, a second pressure plate 11 which holds the can end shell in axial alignment with the first pressure plate 10, and an array of freely rotatable rolls 12 equiangularly spaced around the second pressure plate.

The first pressure plate 10 has a shank 13 for connection to drive means (not shown) which permit reciprocal motion towards and away from the second pressure plate 11. Suitable means to this axial motion include a cam or alternatively a lever. The shank 13 is also operably connected to intermittent drive means (not shown) to make the first pressure plate rotate during axial advance into the array of rolls 12.

The first pressure plate 10 has an underside surface comprising a peripheral thrust surface 14 to engage the seaming panel 3 of the end shell and an annular rib 15 of a diameter to enter the chuck wall 4 of the shell.

The second pressure plate 11 has a top surface comprising a peripheral bead 16 defining a central recess 17. The peripheral bead 16 is only about half the width of the seaming panel 3 so that when the annular rib 15 of the first pressure plate 10 is moved axially to enter the chuck wall 4 of the end shell 1, the peripheral bead 16 of the second pressure plate 11 and peripheral surface 14 of the first pressure plate 10 clamp an inner margin of the seaming panel 3 so that the shell 1 is held firmly in axial alignment with the pressure plates 10, 11 and the skirt 2 of the shell protrudes all round the plates.

The second pressure plate 11 has a stem 18 supported for rotation on a thrust bearing 19 located in a base plate 20. The second pressure plate 11 is supported by a spring 21 in the form of a stack of dished washers resting on the thrust bearing 19 so that the stem 18 of the second pressure plate 11 is able to move axially into the base plate 20 as the clamped shell 1 is moved into the array of rolls 12. The purpose of the spring 21 is to lift the plates 10,11 out of the array of rolls 12 after the end shell has been reformed by rolling into a can end.

Each of the rolls 12 has a work surface in the form of a substantially frustoconical approach surface 22, an annular arcuate surface 23 which defines the finished curl, a cylindrical body 24 and a stem portion 25 which is supported in a ball bearing 26. In this embodiment a pair of ball races supports each roll stem portion 25 for free rotation. Each roll 12 is held in its bearing by a grub screw 27 and washer 28. The bearings are fitted in equiangular spacing around the second pressure plate as is best understood from FIG. 1C.

Referring to FIGS. 1A and 1B it will be understood that the method of reforming the periphery of an end shell comprises the steps of:

(a) clamping a central panel portion 8 of the end shell 1 between the first pressure plate 10 and the second pressure plate 11 so that said plates and end shell are in axial alignment and the skirt 2 of the end shell 1 protrudes around the plates;

(b) entering the clamped end shell 1 into the array of freely rotatable rolls 12 each of which has a profiled work surface to progressively reform the protruding portion of the end shell while effecting relative rolling motion between the work rolls 12 and the protruding skirt 2;

(c) thereafter removing the assembly of reformed can end and plates 10, 11 from the rolls 12 and (d) parting the pressure plates 10, 11 to release the reformed can end having a peripheral curl 9.

Whilst the first pressure plate 10 is driven to rotate in FIG. 1B, it will be understood that one could alternatively achieve the same relative rolling motion by driving the second pressure plate 11 to rotate or even holding the plates 10, 11 stationery and rotating the base plate 20 to move the array of rolls 12 instead.

Figure 3A:
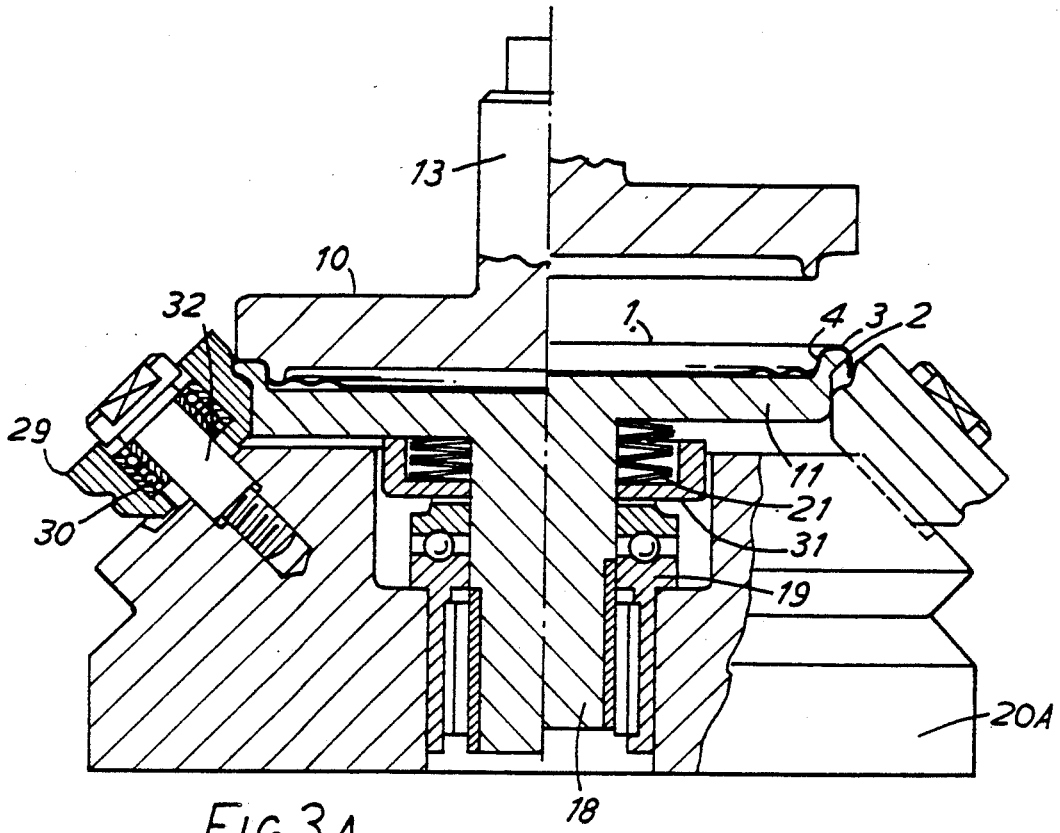
FIG. 3A is a sectioned side elevation of modified apparatus in which the curl forming rolls are inclined to the axis of rotation of the end shell.
Figure 3B:
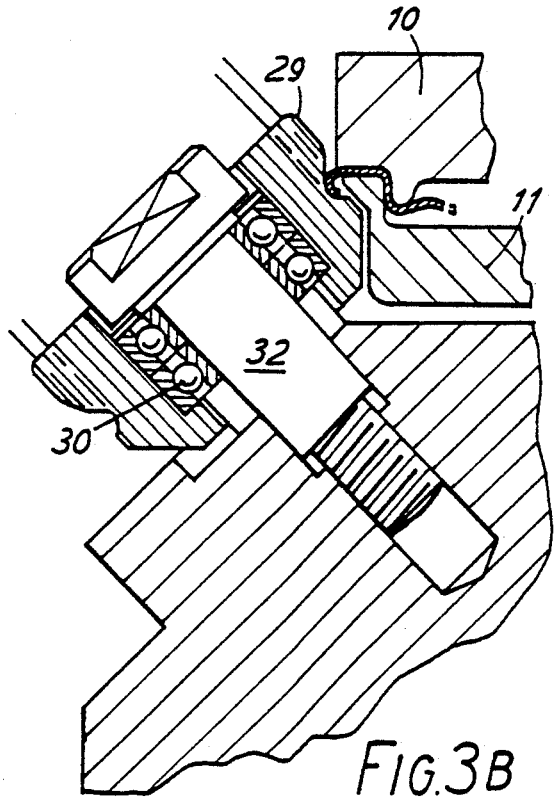
FIG. 3B is a fragmentary section through one of the rolls, chuck and pad of FIG. 3A and a can end formed by curling from the end shell.

FIGS. 3A and 3B show a modified form of the apparatus of FIGS. 1A, 1B and 1C in which each work roll 29 of an array is mounted on a bearing 30 through which passes a stud 32. The axis of the bearing 30 is inclined to the axis of the pressure pads 10/11. The spring 21 is surrounded by a cup 31 the height of which limits downward travel of the second pressure plate 11. In other respects the apparatus works in the manner described with reference to FIGS. 1*a*, 1B, 1C, so like parts are denoted by the same integer numbers.

Referring to FIG. 3B it will be understood that the resolved line of force on the roll 2A arises from a combination of axial crushing of the culindrical skirt 2 of a can end shell 1 and movement of the free edge of the skirt 2 radially inwards. If these axial and radial components of force are approximately equal it is reasomable to incline the stud 32 which supports the bearing 30 and roll 29, at an angle of about 45° to the axis of the pressure pads so that little or no shearing force is applied to the races of bearing 30.

Figure 4A:
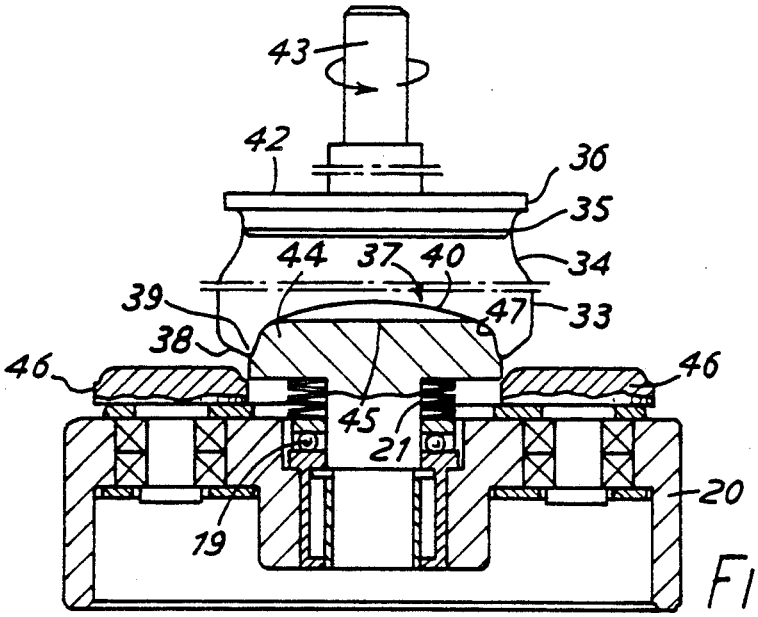
FIG. 4A is a sectioned side elevation of a second embodiment of the apparatus at the commencement of reforming of the bottom wall of a can.
Figure 4B:
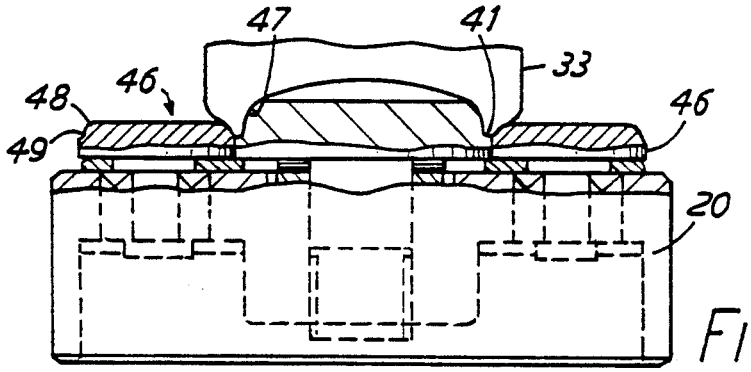
FIG. 4B is a like view of the apparatus of FIG. 4A after reforming of the bottom wall of a can.
Figure 4C:
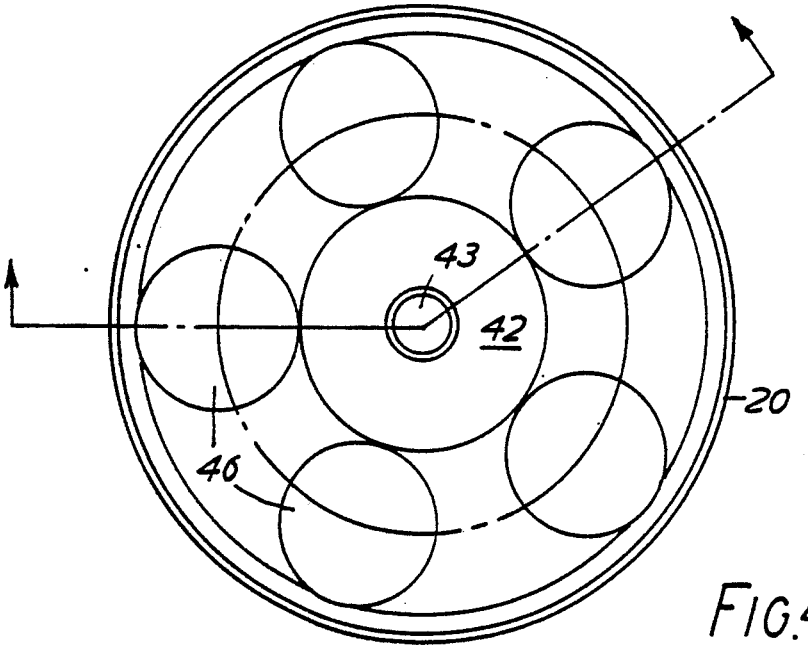
FIG. 4C is a plan view of the apparatus of FIGS. 4A and 4B.

FIGS. 4A, 4B and 4C show an apparatus for reforming a deep drawn or wall ironed can having a cylindrical wall 33 having a shoulder 34, neck 35 and flange 36 defining a mouth at one end and closed at the other end by an integral bottom wall 37. The bottom wall initially comprises a convex or frustoconical annulus 38 connecting the cylindrical wall 33 to a stand bead 39 which connects the annulus 38 to a domed central panel 40. In order to enhance the pressure retaining property of the can bottom, it is necessary to increase the tightness of fold of the stand bead 39. If desired, a stacking rib 41 may also be formed as shown in FIG. 4B. The stand bead 39 has a small radius so that the stand bead of the can body may be nested within a top end of a like can for stable stacking.

Referring to FIGS. 4A and 4C it will be seen that this second embodiment of apparatus comprises a first pressure pad 42 having a shank 43 to receive axial and rotational drive from means (not shown), a second pressure pad 44 having a domed surface 45 (which need not be a complete dome) for entry into the dome 40 of the can bottom to hold the can in axial alignment with the first pressure plate 42; and an array of work rolls 46 arranged around the second pressure plate 44.

The second pressure pad 44 has a curved annular surface 47 to support a peripheral margin of the domed surface 40 of the can bottom while the annulus 38 of the can bottom is pushed onto the annular profiled surfaces of the rolls 46. The profiled surface of each roll comprises an annular covexity 48 and an annular concavity 49 to define a reformed annulus of the can bottom and the stand bead 41 of smaller radius respectively.

As in the embodiments previously described, the second pressure pad 44 is resiliently supported by a spring 21 for rotation on a thrust bearing 19 located in a base plate 20. The base plate 20 also supports each work roll in ball bearings for free rotation.

A benefit arising from use of an array of work rolls is that the working foces are distributed in a balanced array so that the clamped article is not subjected to distortional forces.

We claim:

1. Apparatus for reforming an end wall of a container, the apparatus comprising first support means adapted to be axially displaceable to apply axial pressure to the end wall, second support means adapted to support the end wall in axial alignment with the first support means against the axial pressure, means for rotation of the two support means with the end wall held between them and roll means adjacent the second support means to apply a forming force in a radial direction to progressively reform the end wall, wherein the second support means is a thrust pad having a thrust surface adapted to conform with a central portion of the end wall, and the roll means comprise an array of rolls, each roll of said array being mounted in a stationary non-rotating housing for rotation about a fixed axis and equiangularly spaced from the next roll around the thrust pad, the array of rolls presenting an envelope of thrust which, when the end wall is advanced by the first support means axially into the array of rolls, exerts an inwardly directed thrust force which reduces the diameter of the end wall.

2. Apparatus according to claim 1, for reforming the end wall of a can end shell wherein rolls have a concave annular profile which imparts to the end shell a finished curl.

3. Apparatus according to claim 1, for reforming the can bottom of a one-piece piece can and the rolls have a profile which imparts to the can bottom a frustoconical or concave annulus and annular stand bead having a controlled radius of curvature.

4. Apparatus according to claim 1, wherein each roll is supported by a ball or roller bearing.

5. Apparatus according to claim 4, wherein the bearing is held by a stud the axis of the bearing being inclined to the said axis of rotation and the roll is profiled to deliver thrust in a plane perpendicular to the axis of the bearing.

6. Apparatus according to claims 1, 2 or 3 wherein the second support means or thrust pad is supported for rotation on a thrust bearing and urged to rise from the bearing by a spring.

7. A method for reforming an end wall of a container, said method comprising the steps of (a) clamping the end wall between a first pressure plate and a second pressure plate so that said plates and end wall are in axial alignment and a peripheral portion of the end wall protrudes at least around the second plate;

(b) entering the clamped end wall into an array of freely rotatable rolls, which are mounted in a housing and each of which has a profiled work surface, to progressively reform the protruding portion of the end wall while causing the pressure plates with the end wall clamped between them to rotate while the housing is stationary;

(c) thereafter removing the assembly of reformed end wall and plates from the array; and (d) parting the pressure plates to release the reformed end wall.

8. Apparatus for reforming an end wall of a container, the apparatus comprising first support means adapted to be axially displaceable to apply axial pressure to the end wall, second support means adapted to support the end wall in axial alignment with the first support means against the axial pressure, means for rotation of the two support means with the end wall held between them and roll means adjacent the second support means to apply a forming force in a radial direction to progressively reform the end wall, wherein the second support means is a thrust pad having a thrust surface adapted to conform with a central portion of the end wall, and the roll means comprise an array of rolls mounted in a stationary non-rotating housing and equiangularly spaced around the thrust pad, the array of rolls presenting an envelope of thrust which, when the end wall is advanced by the first support means axially into the array of rolls, exerts an inwardly directed thrust force which reduces the diameter of the end wall, in which each roll is supported by a ball or roller bearing, in which the bearing is held by a stud, the axis of the bearing being inclined to said axis of rotation, and in which the roll is profiled to deliver thrust in a plane perpendicular to the axis of the bearing.

* * * * *